United States Patent [19]

Neumann

[11] Patent Number: 4,909,750

[45] Date of Patent: Mar. 20, 1990

[54] ELECTRIC CONNECTION DEVICE FOR COMPONENTS OF HEATERS AND HEATER UTILIZING SAME

[75] Inventor: Erich Neumann, Munich, Fed. Rep. of Germany

[73] Assignee: Webasto AG Fahrzeugtechnik, Gauting, Fed. Rep. of Germany

[21] Appl. No.: 276,667

[22] Filed: Nov. 28, 1988

[30] Foreign Application Priority Data

Nov. 27, 1987 [DE] Fed. Rep. of Germany ..... 3740195

[51] Int. Cl.[4] ..... H01R 13/52

[52] U.S. Cl. ..... 439/271; 439/736; 439/540; 439/722; 126/116 R

[58] Field of Search ..... 126/110, 116; 439/271–283, 709–713, 717, 718, 722, 247, 502–506, 177, 540, 541, 736

[56] References Cited

U.S. PATENT DOCUMENTS

| | | | |
|---|---|---|---|
| 2,438,371 | 3/1948 | Marholz | 439/247 |
| 3,406,370 | 10/1968 | Gaw | 439/279 |
| 3,660,802 | 5/1972 | Staudt | 439/502 |
| 3,989,029 | 11/1976 | Friedl et al. . | |
| 3,989,030 | 11/1976 | Friedl . | |
| 4,115,665 | 9/1978 | Giacoppo et al. | 439/540 |
| 4,310,210 | 1/1982 | Takahashi et al. | 439/247 |
| 4,451,750 | 5/1984 | Heuer et al. | 439/271 |
| 4,545,632 | 10/1985 | Maier et al. | 439/271 |
| 4,732,546 | 3/1988 | Fehlmann et al. | 439/271 |
| 4,772,213 | 9/1988 | Bell et al. | 439/718 |

FOREIGN PATENT DOCUMENTS

| | | | |
|---|---|---|---|
| 2102782 | 7/1971 | Fed. Rep. of Germany | 439/540 |

*Primary Examiner*—David Pirlot

*Attorney, Agent, or Firm*—Sixbey, Friedman, Leedom & Ferguson

[57] ABSTRACT

An electrical connection device for electrically operated components of heaters, especially vehicle heaters, in which block-shaped plug parts are molded on the lines coming from the components. The block-shaped plug parts are grouped side-by-side into a unit and a cap is attached to this unit. The cap has connection parts which are designed to be complementary to connection parts of the block-shaped plug parts so that a plug-in electrical connection is formed when the cap is mounted to the unit. Accoding to a preferred embodiment, the block-shaped plug parts are placed directly on the outside of a housing of a heater and they are connected with each other to form the unit with the help of interlocking connections and the cap. In another embodiment, the block-shaped plug parts are grouped into a unit and held together by a support having a pocket for each block-shaped plug part which is fastened to the heater by a holder.

33 Claims, 3 Drawing Sheets

ELECTRIC CONNECTION DEVICE FOR COMPONENTS OF HEATERS AND HEATER UTILIZING SAME

BACKGROUND OF THE INVENTION

The invention relates to an electrical connection device for components of heaters, especially vehicle heaters, such as ignition devices, sensors, motor drive devices or the like, in which lines coming from the components are combined for interconnection, by means of the connection device, with a power supply line that runs from the connection device to a control device and/or power supply.

Until now the lines coming from the components were combined into a kind of cable tree, and connector boxes or the like were used for the interconnection. Especially in heaters to be installed in vehicles, difficulties arise with respect to watertightness when such a method of connection is used, since it cannot always be guaranteed that the heaters are installed in a splashproof area of the vehicle. Further, it is time consuming to make an electric connection in the manner stated above and polarity reversals, i.e., incorrect terminal connections, occur time and again, since exact knowledge and experience are necessary to differentiate among the multiplicity of lines coming from the various components and then to connect them correctly to an electric connector.

An attempt has also been made to combine the lines in a chamber on the heater, which is then closed, especially in a watertight manner, by a cover. Such a chamber must be taken into consideration in designing a housing for the heater and, therefore, leads to a cost increase in the production of the housing. Examples of vehicle heaters having a housing with an integral chamber for various electrical components can be found in U.S. Pat. Nos. 3,989,029 and No. 3,989,030.

SUMMARY OF THE INVENTION

The primary object of the invention is to provide an electric connection device of the type initially mentioned which makes possible, in a simple way as regards production technology, a terminal connection for the lines coming from the heater components which is polarity reversal-proof, easy to assemble, and easy to service, as well as being able to be sealed tight with respect to the environment.

According to preferred embodiments of the invention, an electric connection device for components of heaters, especially vehicle heaters of the type initially mentioned, is provided with a block-shaped plug part that is molded on the lines coming from the respective components, and the block-shaped plug parts are grouped into a unit, upon which a cap with complementary plug parts may be placed.

Thus, in the electrical connection device according to the invention, a block-shaped plug part is assigned to each component and to the connecting lines assigned to them, a plug which is directly molded on the lines, so that mistakes and polarity reversals are largely out of the question. As a result, the interconnection is simplified since it is not necessary to wire up and connect separately the individual lines coming from the components to the electrical connection, a plug part already being integrated with this terminal connection. The electric connection on the electrical connection device is then completed by putting a cap on the unit of block-shaped plug parts, which exhibits corresponding complementary plug parts that work together with the block-shaped plug parts. Thus, by putting on the cap, an electrical interconnection occurs as a result of the combined action of the block-shaped plug parts and the complementary plug parts on the cap. Further, the layout of the electric connection device according to the invention is extremely easy to service since, in case of breakdown, the component together with the lines and the molded-on plug part are removed from the grouped unit and are replaced by a corresponding new subassembly. Thus, only the cap needs to be removed from the grouped unit and, after the replacement, only the cap needs to be put again on the unit.

To achieve a reliable cohesion of the group of block-shaped plug parts, the cap is suitably so designed that, on the one hand, it is more rigid than the group of block-shaped plug parts and, on the other hand, it encloses the unit at least partly.

According to an advantageous embodiment of the invention, sleeves are incorporated, preferably floating, in the block-shaped plug parts and the cap has pins, so that by cooperation of both parts a plug connection is established. Of course, the arrangement can also be reversed. If the pins are provided on the cap, then they are suitably injected into a fixed position there and placed in a predetermined arrangement.

Advantageously, according to the invention, the block-shaped plug parts of the electric connector are placed next to each other in a manner producing a design of the electric connector that is as flat as possible.

Preferably, the block-shaped plug parts are made of a flexible material, such as soft rubber, so that the grouped unit is compressible when the cap is put on and attached firmly to hold together the entire electric connection device, thus obtaining a watertight seal.

The layout of the electric connection device according to the invention is suitably made so that the connectors, acting in cooperation with the cap, are integrated in the block-shaped plug parts, so that the block-shaped plug parts with the connectors, the lines leading to the respective components and the components form a unit which can be prefabricated at favorable cost. Thus the production costs can be reduced.

An advantageous embodiment of the electric connector according to the invention is distinguished by the fact that the respective block-shaped plug part and/or the cap are matched to the outside contour of the heater, as a result of which at least one surface of these parts has to have an appropriately matching layout. Suitably this surface has an arcuate shape. As a result, the entire electric connector adapts itself attractively to the outside contour of the heater housing and no additional parts are required for attaching the electric connection device beyond the single fastening screw already providing for securing the cap to the unit of plug parts.

Suitably, according to invention, the layout can be arranged so that a cable cover is provided on the cap in one piece therewith and which, preferably, is also matched to the outside contour of the heater. By means of this cable cover, the lines coming from the components are brought together ahead of the molded-on block-shaped plug parts so that damage to these connecting lines, during installation of the heater, can be avoided since they are protected by the cable cover.

To make the electrical connection device according to the invention easy to check, the lines coming from the components with the block-shaped plug parts are suitably placed on one common side of the grouped unit. As a result, a common feed side is obtained on the electrical connection device which is then chosen so that it is easily accessible, even with the heater installed, if necessary, to be able to perform maintenance work quickly and conveniently. Of course, the block-shaped plug parts can also be placed according to the respective position of the components.

Preferably, the cap of the electrical connection device according to the invention has an outlet for the power supply line leading to the control device and/or the electric power supply. Here, the outlet can contain a strain relief device for the outgoing power supply line to prevent malfunctions caused by a tension load on the outgoing power supply line. As an alternative, the end portion of the power supply line can be integrally molded within the cap. Preferably, the outlet is designed as a tubular appendage for enclosing the end portion of the power supply line, and which is, preferably, directly molded onto the cap. Thus, in such a layout of the electrical connection according to the invention, the outgoing power supply line is also directly incorporated in the cap, so that the power supply line need not be separately connected and fastened to the complementary plug parts of the cap. Thus connecting mistakes can be effectively avoided in this area, too.

To avoid mixups of the block-shaped plug parts in the grouping of the unit to be formed, according to the invention, the layout can be so arranged that the block-shaped plug parts each are individually shaped, i.e., that the block-shaped plug parts of the respective components differ from one another. Further, the block-shaped plug parts in the grouped arrangement can have an interlocking connection and can be connected with one another while forming a watertight seal, and these interlocking connections, too, can be made mistake-proof to avoid mixups of the block-shaped plug parts of the components in question. To form this interlocking connection, each block-shaped plug part suitably has a projecting part on one side and a corresponding recessed receiving part on the opposite side, a receiving part into which the respective projecting part of the adjoining block-shaped plug part can positively engage. By this interlocking connection, the cohesion of the block-shaped plug parts relative to each other is strengthened in the grouped unit. The interlocking connection is suitably placed in a plane of the electrical connection device which extends parallel to the lateral sense of the block-shaped plug parts, so that, especially in the grouped arrangement of the block-shaped plug parts next to each other, they rest against each other and are protected from splashing water.

To guarantee a direct connection with the cap, especially so as to provide a watertight seal, the respective block-shaped plug part can have a projecting sealing rim which, when the block-shaped plug parts are placed next to each other, form a grouped sealing rim on which the corresponding sealing rim of the cap is pressed when the electric connector is completely mounted, so that no moisture can get to the plug parts on the cap and block-shaped plug parts.

An alternative embodiment of the electric connector according to the invention is distinguished in that the block-shaped, molded-on plug parts coming from the respective components are received in a rigid support, and the cap is rigidly formed and solidly connected with the support. In such a layout the block-shaped molded-on plug parts may all be identical, resulting in a further simplification of production and especially making possible secure cohesion of the rigid support surrounding the molded-on plug parts of the unit. Here, the plug parts can be differently positioned to avoid polarity reversals or faulty polarities.

Advantageously, a continuous seal is placed between the cap and the support, so that the space enclosed by the cap and the support is reliably sealed tight, especially in a watertight manner.

To receive the block-shaped plug parts on the support, plug-in pockets can be provided into which the block-shaped plug parts can be quickly inserted in the desired sequence. If the block-shaped plug parts are made of flexible material, then the inherent elasticity of the block-shaped plug parts can be used to retain the latter safely in the plug-in pockets of the support.

The above-mentioned arrangement of the electrical connection device, comprised of cap, support and the plug parts provided in the latter, can be attached to the outer housing of the heater with the help of a holder, in which, advantageously, the connection of holder and arrangement of the electrical connection device can be combined with the help of a common fastening device, such as, for example, a fastening screw extending therethrough.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
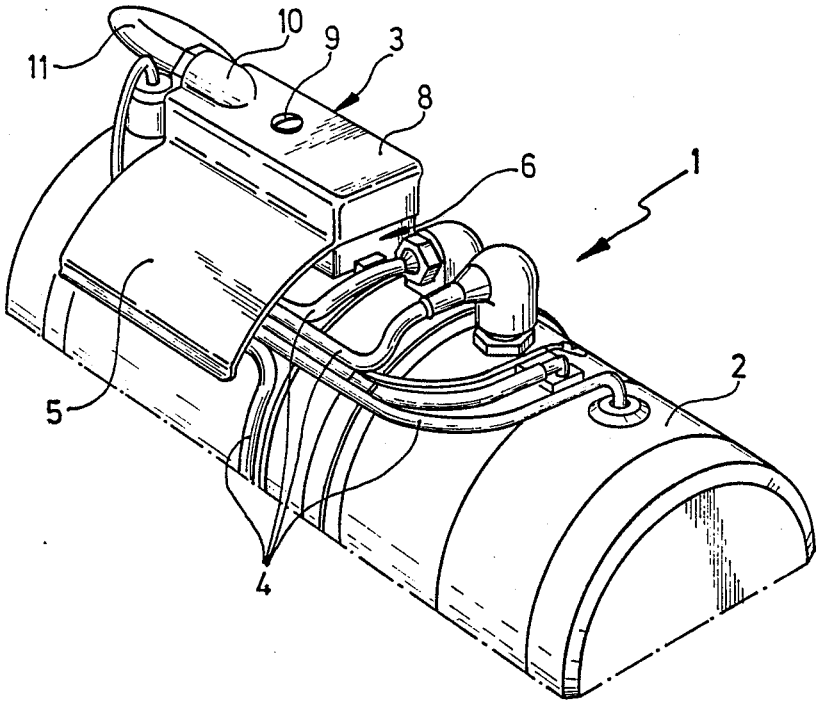
FIG. 1 is a partial perspective view of a heater with an electrical connection device according to the invention.

In FIG. 1, an embodiment of a heater identified overall as 1 is shown which has an outer housing identified as 2. The electrical connection device, as a whole, is identified as 3. As can be seen from FIG. 1, power/control lines 4, which suitably are each formed by a single-line pair, go from the electrical components of heater 1. These components can be the ignition device, flame detectors, temperature fuses, sensors, such as temperature sensors, and the like, of the heater 1. The number of components to be connected and interconnected with the help of electrical connection device 3 also depends on the heater type, i.e., whether it is a heater using a liquid heat transfer medium, such as a water heater, or a heater using a gaseous heat transfer medium, such as an air heater. Lines 4 coming from the respective components are brought together, preferably, before electrical connection device 3 on one side of the latter and before entry of the lines 4 into the electrical connection device 3, and are protected by a cable cover 5. To achieve line paths to the components that are as short as possible, the power/control lines 4 from the components, also, can enter the electrical connection device on different sides, depending on the positions of the respective components.

Electrical connection device 3 comprises a grouped unit 6, consisting of several block-shaped plug parts 7, which will be explained in more detail below, and a cap 8, which is put on grouped unit 6 and partially encompasses this unit 6. Cap 8 and grouped unit 6 are solidly connected to each other, for example, with the help of a through bolt 9. As represented, cable cover 5 is a molded-on portion of cap 8 and further, the cap has an outlet 10 for a power supply line going from the electrical connection device 3, e.g., to a control device and/or a power supply device, that is not shown in detail. According to the embodiment shown, outlet 10 can be molded onto cap 8.

Figure 2:
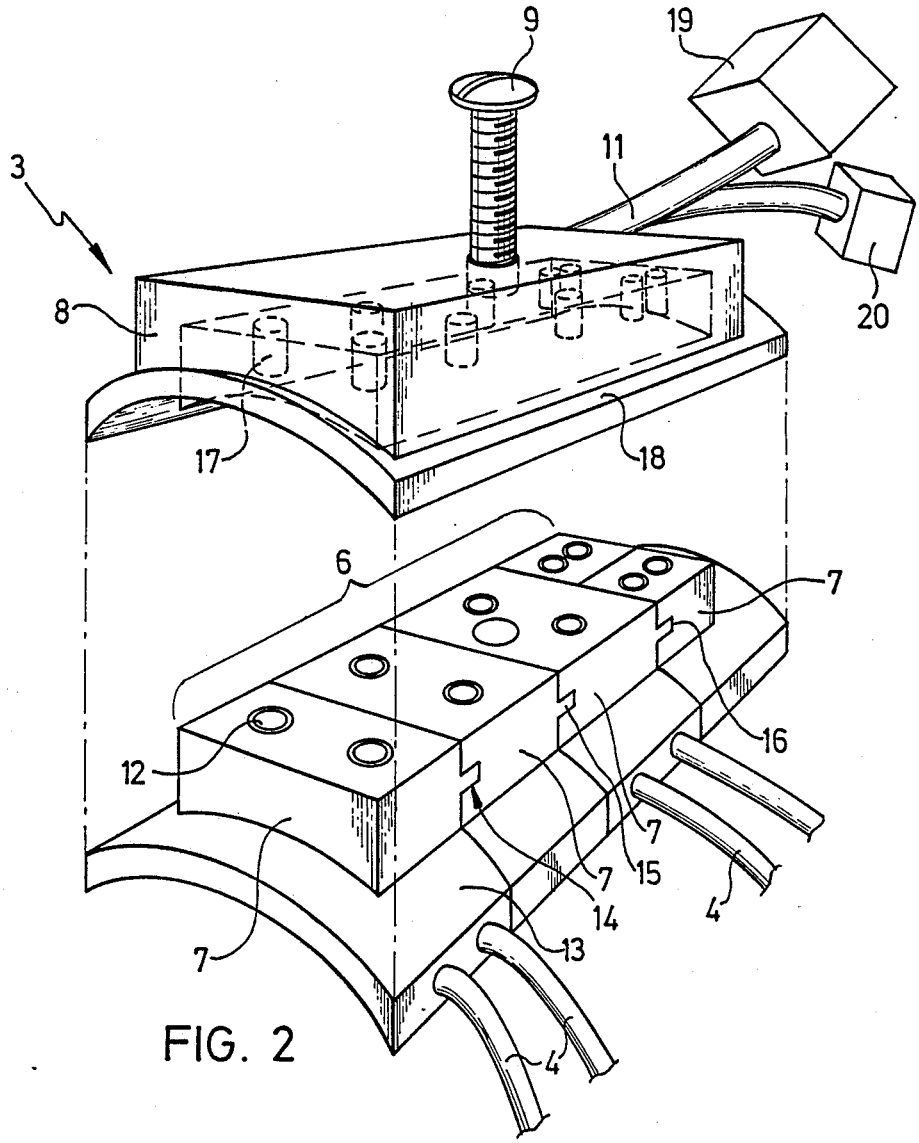
FIG. 2 is an exploded perspective view of a first preferred embodiment of the electrical connecting device according to the invention.

FIG. 2 shows a first preferred embodiment of the electrical connection device 3 with grouped unit 6 consisting of block-shaped plug parts 7 without a detailed representation of the heater. Cap 8 is shown detached for purposes of explaining how it works together with unit 6.

The individual block-shaped plug parts are all designated 7 in FIG. 2, but they differ from one another with respect to shape and/or size to achieve a shape that is individual to the respective components of heater 1. The block-shaped plug parts 7 have a domino-like appearance with the lines 4 coming from the respective electrical components being directly integrated into the block-shaped plug parts 7. In the embodiment shown in FIG. 2, the block-shaped plug parts 7 contain, for example, floating sleeves 12, which form one of the parts of a plug connection in conjunction with cap 8. These sleeves 12 could also be fixedly positioned in shaping block-shaped plug parts 7. Further each block-shaped plug part 7 exhibits a rim 13 that projects outward at its base in a manner so that a continuous shoulder is formed when all of the parts 7 are grouped, for example, in the longitudinal direction, into unit 6.

The block-shaped plug parts 7, as shown in unit 6, when combined into a group, are positively connected with each other. This positive connection may be in the form of an interlocking connection 14, that is placed in a plane parallel to the base of the respective block-shaped plug parts 7. For forming interlocking connection 14, each intermediate block-shaped plug part 7 has a projecting part 15 on one side and a slot-shaped recess 16, serving as a receiving part on an opposite side. The projecting part 15 of one adjacent block-shaped plug part 7 engages the slot-shaped recess 16 of an adjacent block-shaped part 7 to establish the interlocking connection 14. By the use of such interlocking connections 14, the desired watertightness is achieved at the same time as unification of parts 7. Of course, the block-shaped plug parts 7, that are to be located at the ends of grouped unit 6, are differentiated from the intermediate block-shaped plug parts 7 by being so shaped that, e.g., only a slot-shaped recess is formed on one side for one end part and merely a projecting part 15 is provided for the other end part(s).

In the embodiment shown in FIG. 2, block-shaped plug parts 7 are different from one another. The block-shaped plug part 7 lying at the left or front is narrow and exhibits only a projecting part 15, while the opposite end is formed of two smaller, laterally arranged parts. The block-shaped plug parts 7 lying in the middle are each provided with a projecting part 15 and a slot-shaped recess 16, but are different from each other in dimensions. To avoid mixups and confusion of block-shaped plug parts 7, a layout is made by this design so that a single sequence of block-shaped plug parts 7 in grouped unit 6 is unambiguously predetermined. Of course, more block-shaped plug parts 7 can be provided than those in the example shown in FIG. 2, or optionally also fewer. The number of parts 7 depends, essentially, on the type of heater 1.

The cap 8, preferably, is made of a rigid material, while block-shaped plug parts 7 are formed of a flexible material, such as, e.g., soft rubber. This cap 8 contains complementary plug parts 17 which, preferably, are embedded in cap 8 so as to be firmly held in a predetermined order. These complementary plug parts 17, in the example shown, are formed by pins which engage respective sleeves 12 of block-shaped plug parts 7 when cap 8 is put on unit 6, and thus, establish an electrical connection of the parts 7 with the power supply line 11 of cap 8. Cap 8 is so designed that it encompasses the block-shaped plug parts 7 of grouped unit 6 to hold the parts 7 reliably together. Further, cap 8, according to FIG. 2, has a circumferential rim 18 at its open side which partly rests on rim 13 of block-shaped plug parts 7 and partly overlaps it. In cooperation with rims 13 of block-shaped plug parts 7, rim 18 of cap 8 forms a seal to prevent penetration of moisture into the electric connection device 3. Of course, the seal thus provided and formed by the cooperation of rims 13 with rim 18, can also be achieved in other manners from that shown. For example, it could be enough for the cap to have only a narrow projecting sealing rim 18 which merely rests on rims 13 of block-shaped plug parts 7 and a tight connection is achieved by the two rims 13, 18 being pressed against each other when cap 8 is attached with the help of fastening screw 9.

As can be seen in more detail from FIG. 1, outlet 10 for power supply line 11 is formed on cap 8. Power supply line 11 leads to a control device 19 for heater 1 and a power supply device 20, both of which are merely diagrammatically illustrated. Even though not shown in detail in FIG. 3, cable cover 5 can be molded on cap 8.

The embodiment of electrical connection device 3, explained by means of FIG. 2, is so designed that it can be attached directly to the exterior of outer housing 2 without any intermediate support of heater 3 as shown, e.g., in FIG. 1. Therefore, as shown, the surfaces of the block-shaped plug parts 7 and of the cap which engages the exterior of outer housing 2 of heater 1 are shaped for matching the arcuate contour of housing 2, so that the entire electric connector 3 fits flush on the exterior surface of outer housing 2.

As can be seen from FIG. 2, block-shaped plug parts 7 are directly molded on lines 4 coming from the respective electrical components of the heater and, thus, form a physically connected unit with the components. Furthermore, since the individual block-shaped plug parts 7 in grouped unit 6 are held together among each other by cap 8 and are provided with floatingly mounted sleeves 12, deviations caused by tolerances of the parts can be compensated for, thereby ensuring that the plug connection of cap 8 with block-shaped plug parts 7 is always realizable. Of course, it is also possible to insert protruding pins in block-shaped plug parts 7 or to embed them firmly in the plug parts. The complementary plug parts on cap 8 then, for working together with these protruding pins, are formed with correspondingly designed sleeves. Also, optionally, combinations for achieving the connection of the complementary plug parts in the case of electrical connection device 3 are possible, so that, for example, some block-shaped plug parts 7 have pins and others have sleeves, while corresponding complementary parts are provided in cap 8.

Figure 3:
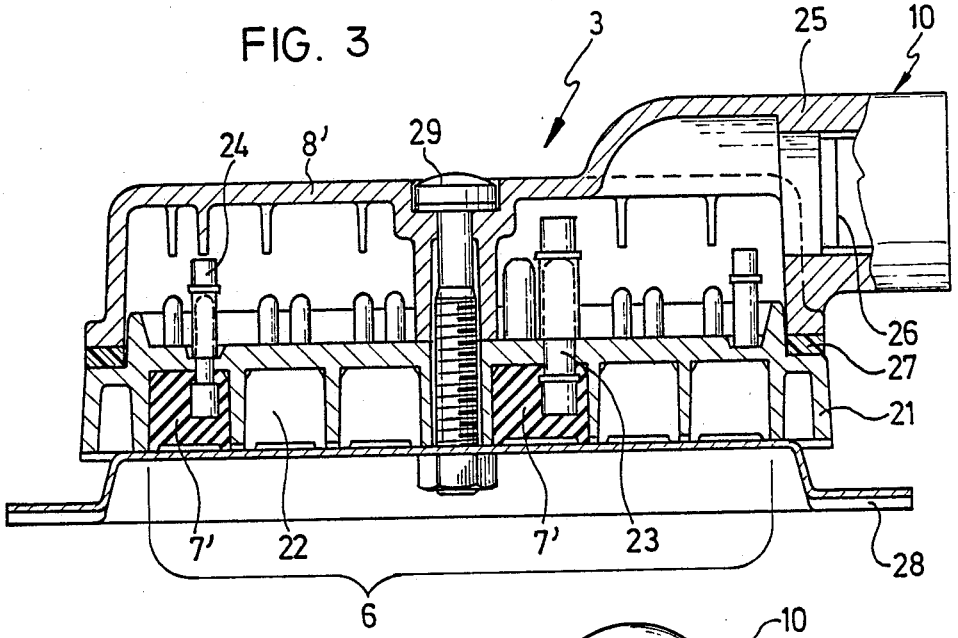
FIG. 3 is a longitudinal sectional view of a second preferred embodiment of the electrical connection device according to the invention with a support for block-shaped plug parts.
Figure 4:
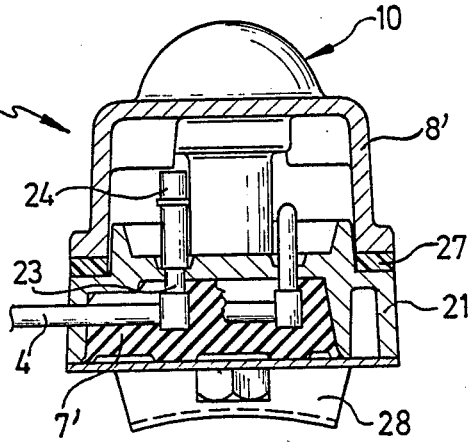
FIG. 4 is a cross-sectional view of the electrical connection device according to FIG. 3.
Figure 5:
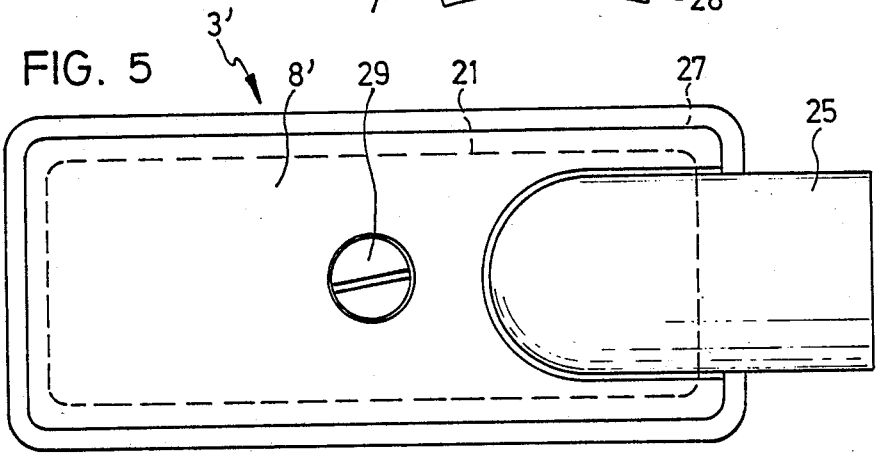
FIG. 5 is a top view of the electrical connection device according to FIG. 3.

In FIGS. 3 to 5, a second preferred embodiment of an electrical connection device is illustrated in detail, with respect to which prime (') designations are used to differentiate like numbered corresponding parts of the preceding embodiment; for example, the modified connection device is identified as 3', in this case. This electric connector 3' essentially differs from the preceding embodiment in that a support 21, formed preferably of a rigid material, is provided. In support 21, plug-in pockets 22 are formed which receive block-shaped plug parts 7' that are molded on the lines 4' coming from the respective components.

In the embodiment shown in FIG. 4, for example, two such block-shaped plug parts 7' are shown in the condition where they have been inserted into plug-in pockets 22 of support 21. These block-shaped plug parts 7' have projecting pins 23 for forming the plug connection, which are embedded in the respective block-shaped plug parts 7' together with lines 4. While parts 7' may each be uniquely shaped, relative to each other, as to body configuration and as to placement and/or size of pins 23 to ensure that each part 7' may be received in only a predetermined pocket 22 that has been coordinated thereto, in this embodiment, block-shaped plug parts 7' can be identical with each other as regards to their dimensions and the like, so that production thereof is simplified. At the same time, rigid support 21 serves to stiffen the unit 6' of block-shaped plug parts 7'.

Cap 8', in the embodiment of electrical connection device 3' according to FIGS. 4 through 6, has sleeves 24 which are complementary to the pins 23 which are plugged therein to establish the electrical connection. An outlet 10' for a power supply line is formed by a tubular plug 25 that is molded on cap 8'. Plug 25 contains a conventional strain relief device 26 for the power supply line. If, in an alternative configuration, the power supply line 11 is directly embedded into cap 8' during molding thereof (not shown), the strain relief device can be omitted.

As can be seen especially from FIGS. 3 and 4, a continuous seal 27 is placed between cap 8' and support 21 to achieve a moisture-proof seal of electrical connection device 3'. The electrical connection device 3' is attached to the outer housing 2 of heater 1 with the help of a holder 28, and the arrangement of support 21 with inserted block-shaped plug parts 7' and cap 8' is solidly connected together and to holder 28 by a through-bolt 29. In this connected condition of electrical connection device 3', the continuous seal 27 is compressed between the cap 8' and the support 21.

Of course, the complementary plug connection parts 23, 24 of support 21 and cap 8' can be designed in the opposite way. A combination of both embodiments is also possible, as was explained above relative to the FIG. 2 embodiment. For example, similar to the embodiment of FIG. 2, the block-shaped plug parts 7', together with the components associated with them, can be removed from support 21 in the course of maintenance work when cap 8' is removed from support 21 and then can be replaced by appropriate new ones. Although not shown in detail in FIGS. 3 through 5, on cap 8', similar to the embodiment according to FIG. 2, a cable cover 5 can also be attached or, more suitably, molded on. Also, combinations of both embodiments can be created by providing a variation of FIG. 2 with and of FIGS. 3 through 5 without support 21.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Electrical connection device for components of heaters, especially vehicle heaters, such as an ignition device, sensors, motor drive devices and the like, in which lines coming from the respective components are combined for interconnection with a power/control supply line, comprising a plurality of block-shaped plug parts wherein a separate block-shaped plug part is molded on the respective lines coming from each of the components; wherein said block-shaped plug parts are removably grouped into a unit; and wherein a cap that is detachably mountable on the unit is provided, complementarily shaped electrical connector parts of the plug parts and cap being engaged upon mounting of the cap on the unit, said cap encompassing said plurality of block-shaped plug parts upon mounting such that said cap engages said block-shaped plug parts as a unit.

2. Electrical connection device according to claim 1, wherein the cap at least partly encloses said block-shaped plug parts of the unit.

3. Electrical connection device according to claim 1, wherein said block-shaped plug parts are shaped in a manner enabling them to be grouped into a side-by-side arrangement to form said unit.

4. Electrical connection device according to claim 1, wherein said block-shaped plug parts are formed of a flexible rubber or rubber-like material.

5. Electrical connection device according to claim 1, wherein the electrical connectors of the block-shaped plug parts are integrated therein.

6. Electrical connection device according to claim 1, wherein said cap is matched to at least one surface on an outer contoured surface of a heater for which it is intended.

7. Electrical connection device according to claim 1, wherein each block-shaped plug part is differently shaped from the other plug parts.

8. Electrical connection device according to claim 1, wherein each block-shaped plug part forms an interlocking connection with any adjoining block-shaped plug part to achieve watertightness.

9. Electrical connection device according to claim 1, wherein a sealing rim is molded on each block-shaped plug part, said sealing rim in combination with said cap providing a watertight sealing of the electrical connection device.

10. Electrical connection device according to claim 1, wherein the complementarily shaped connector parts of the block-shaped plug parts and cap are sleeves and pins for forming a plug-type connection.

11. Electrical connection device according to claim 10, wherein said sleeves are mounted in the block-shaped plug parts in a floating manner.

12. Electrical connection device according to claim 11, wherein said pins are firmly embedded in the cap.

13. Electrical connection device according to claim 1, wherein each block-shaped plug part is matched to at least one surface on an outer contoured surface of a heater for which it is intended.

14. Electrical connection device according to claim 13, wherein the surface of the heater that is matched has the shape of a circular arc.

15. Electrical connection device according to claim 14, wherein said cap is matched to at least one surface on an outer contoured surface of a heater for which it is intended.

16. Electrical connection device according to claim 1, wherein said cap has a cable cover, for the lines on which the block-shaped plug parts are molded, molded thereon.

17. Electrical connection device according to claim 16, wherein the cable cover is matched to an outer contoured surface of a heater.

18. Electrical connection device according to claim 16, wherein the block-shaped plug parts are molded on the lines coming from the components such that, when the plug parts are grouped in said unit, all of lines from the components are located on a common side of the unit.

19. Electrical connection device according to claim 1, wherein said cap has an outlet for the power supply line formed thereon.

20. Electrical connection device according to claim 19, wherein said outlet contains a strain relief device for the power supply line.

21. Electrical connection device according to claim 19, wherein the outlet is formed as a tubular appendage for enclosing an end portion of said power supply line.

22. Electrical connection device according to claim 21, wherein said outlet for the power supply line is molded on said cap.

23. Electrical connection device according to claim 8, wherein each interlocking connection is comprised of a projecting part and a corresponding recessed receiving part for the projecting part.

24. Electrical connection device according to claim 23, wherein said interlocking connection extends parallel to a width direction of the connection device.

25. Electrical connection device according to claim 1, wherein said block-shaped plug parts are received in a rigid support, and wherein said cap has a rigid form and is solidly connected with the support.

26. Electrical connection device according to claim 25, wherein a continuous seal is placed between the cap and the support.

27. Electrical connection device according to claim 25, wherein the block-shaped plug parts are all shaped alike.

28. Electrical connection device according to claim 27, wherein plug-in pockets are provided in said support, a respective block-shaped plug part being received in each pocket.

29. Electrical connection device according to claim 25, wherein a plug-in pocket is provided in said support, a respective block-shaped plug part being received in each pocket.

30. Electrical connection according to claim 29, wherein a holder is provided for attaching the support to the outside of a heater.

31. A heater for vehicles and the like comprising a heater housing enclosing electrically operated components from which electrical lines run and an electrical connection device detachably mounted to said heater housing and forming an interconnection means for electrically connecting the lines from the components to a power/control supply line, said electrical connection device comprising a plurality of block-shaped plug parts wherein a separate block-shaped plug part is molded on the respective lines coming from each of the components; wherein said block-shaped plug parts are removably grouped into a unit; and wherein a cap that is detachably mountable on the unit is provided, complementarily shaped electrical connector parts of the plug parts and cap being engaged upon mounting of the cap on the unit, said cap encompassing said plurality of block-shaped plug parts upon mounting such that said cap engages said block-shaped plug parts as a unit.

32. A heater according to claim 31, wherein said block-shaped plug parts are shaped in a manner enabling them to be grouped into a side-by-side arrangement to form a unit, and wherein a surface of each block-shaped plug part is matched to an outer surface contour of the heater housing for mounting there against.

33. A heater according to claim 31, wherein said block-shaped plug parts are received in a rigid support, plug-in pockets being provided in said support, a respective block-shaped plug part being received in each pocket, and wherein said cap has a rigid form and is solidly connected with the support.

* * * * *